United States Patent [19]

Bromwell

[11] 4,314,428

[45] Feb. 9, 1982

[54] OVERCLADDING STRUCTURE FOR A ROOF

[76] Inventor: Michael A. J. Bromwell, 32 Ferrestone Rd., Wellingborough, Northamptonshire, England

[21] Appl. No.: 93,732

[22] Filed: Nov. 13, 1979

[30] Foreign Application Priority Data

Nov. 17, 1978 [GB] United Kingdom ..... 44947/78

[51] Int. Cl.[3] ..... E04B 7/00

[52] U.S. Cl. ..... 52/22; 52/404; 52/480; 52/483; 52/743; 52/747

[58] Field of Search ..... 52/22, 479, 480, 513, 52/481, 90, 410, 486, 404, 17, 409, 478, 483, 94, 95, 544, 545, 546, 547, 548, 549, 550, 551, 552, 553, 554, 743, 747

[56] References Cited

U.S. PATENT DOCUMENTS

| | | | |
|---|---|---|---|
| 284,141 | 8/1883 | Murtfeldt | 52/22 |
| 1,669,736 | 5/1928 | Bonsall | 52/17 |
| 2,070,648 | 2/1937 | Calkins | 52/90 |
| 2,108,885 | 2/1938 | Griebsch | 52/303 |
| 2,634,832 | 4/1953 | Hammitt | 52/486 |
| 2,822,764 | 2/1958 | Widman | 52/550 |
| 3,210,896 | 10/1965 | Detman | 52/22 |
| 3,225,872 | 12/1965 | O'Brien | 52/90 |
| 3,258,887 | 7/1966 | Mostoller | 52/478 |
| 3,282,012 | 11/1966 | DuPradal | 52/549 |
| 3,456,412 | 7/1969 | Decombas | 52/486 |

FOREIGN PATENT DOCUMENTS

| | | | |
|---|---|---|---|
| 645898 | 7/1962 | Canada | 52/520 |

*Primary Examiner*—John E. Murtagh

[57] ABSTRACT

An overcladding structure for the roof of a building, to form a fresh roof overcladding the existing roof without needing to remove the existing roof and disrupting the inside use of the building, comprises fresh sheeting secured in position by anchoring to purlins of the existing roof. Short channel members are placed on the roof above and at intervals along the existing purlin and elongate Z section bearers are placed over these, and anchored by hook bolts to the existing purlins to strengthen the existing purlins. The fresh sheeting is bolted to the bearers and thermal insulating material may fill the space between existing roof and the fresh sheeting.

5 Claims, 5 Drawing Figures

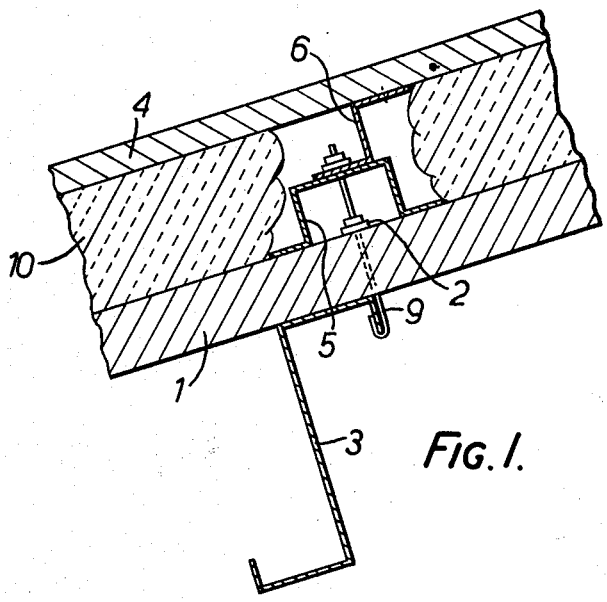
FIG. 1.
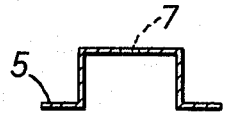
FIG. 2.
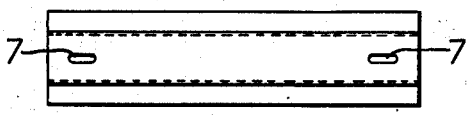
FIG. 2A
FIG. 3
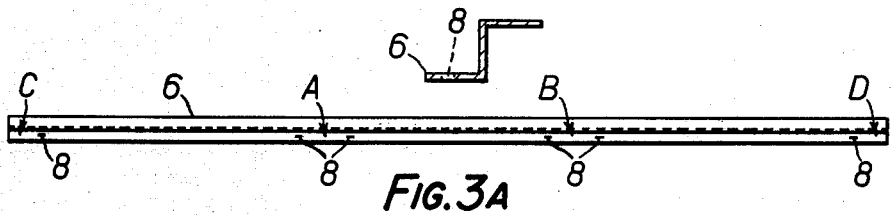
FIG. 3A

OVERCLADDING STRUCTURE FOR A ROOF

BACKGROUND OF THE INVENTION

This invention relates to an overcladding structure for the roof of a building, to form a fresh roof overcladding the existing roof.

A commonly found form of pitched or sloping roof for factories, warehouses and other large buildings comprises corrugated sheeting (usually asbestos) laid onto and secured directly to purlins, several parallel purlins being provided and spaced apart up the slope of the roof. The underside of this sheeting is the ceiling of the used interior of the building and there is no thermal insulation. If the roof becomes damaged and requires replacing, or if thermal insulation is to be provided to reduce heating costs, this hitherto has involved removing the existing roof, usually section-by-section, with consequent disruption of the normal use of the building.

SUMMARY OF THE INVENTION

In accordance with this invention, there is provided an overcladding structure for the roof of buildings, in which the existing roof is overclad with fresh sheeting to form a fresh roof overcladding the existing roof, the fresh sheeting being secured in position by anchoring to purlins of the existing roof. The overcladding structure may form a fresh roof effectively replacing a damaged existing roof, or provide thermal insulation for the existing roof by means of thermal insulating material provided between the existing roof and the fresh sheeting, and the work can be carried out by working on the upper side of the roof and without removing sections of the roof and thereby disrupting the normal use of the building.

BRIEF DESCRIPTION OF THE FIGURES

An embodiment of this invention will now be described, by way of example only, with reference to the accompanying drawing, in which:

FIG. 1 is a section through part of a roof, showing the thermal insulation and fresh sheeting overcladding the existing roof and showing also the anchoring to an existing purlin;

FIGS. 2 and 2A show in section and in plan, respectively, a channel bearer member used to anchor the fresh sheeting; and FIGS. 3 and 3A show in section and in plan, respectively, a Z-shaped bearer member used to anchor the fresh sheeting and providing an additional purlin.

DETAILED DESCRIPTION

In the example shown in FIG. 1, the invention is shown applied to an existing roof or asbestos corrugated sheeting 1 bolted by hook bolts (one of which is indicated at 2) to Z-shaped (Z-section) steel purlins 3: a plurality of these purlins extend parallel to each other and are spaced apart up the slope of the roof, which is either pitched or sloping. Alternatively, the existing purlins may comprise an angle section or circular section.

In order to provide the thermal insulation, the existing roof is overclad with corrugated sheeting 4, for instance steel sheeting, with insulating material 10 such as fiberglass infilling the space between the existing roof sheeting 1 and the fresh, overcladding sheeting 4. The fresh sheeting 4 is both spaced from the existing roof and secured in position by an arrangement comprising channel bearer members 5 (as shown in FIGS. 2 and 2A) and Z-shaped (Z-section) bearer members 6 (as shown in FIGS. 3 and 3A).

The channel bearer member 5, referring to FIGS. 2 and 2A, is a channel section as shown formed in this example from galvinized mild steel. The member is 375 mm long, is provided along its middle with two slotted bolt holes 7 with 300 mm between centers, and in section has the dimensions shown in the Figure.

The Z-shaped bearer member 6, referring to FIGS. 3 and 3A, is a simple Z section also formed in this example from galvinized mild steel. In section, it has the dimensions shown in the Figure, and it has an overall length of 3044 mm with slotted bolt holes 8 provided along the middle of its base section at the spacing shown in the Figure.

Returning to FIG. 1, channel bearer members 5 are placed on the upper side of the existing roof at 1 meter spacing (between centers) along the existing purlins. Then, above each existing purlin, a Z-shaped bearer member 6 is laid on top of the channel bearer members 5 which have already been positioned over that purlin, the Z-shaped bearer member 6 being positioned so that its bolt holes 8 align with the bolt holes 7 of the channel bearer members 5: in this connection, it will be noted from FIG. 3 that the spacings of the holes 8 in Z-shaped bearer member 6 are such that channel bearer members 5 should be positioned at A and B, but also at C and D to receive the ends of adjacent Z-shaped bearer members laid end-to-end with the one shown. Standard hook bolts 9 (FIG. 1) are inserted through the aligned holes of the bearer members 5 and 6 and through holes bored in the existing roof, to engage the downturned edge of the existing purlin 3. Thus, the hook bolts 9 clamp the bearer members 5 and 6 together and onto the existing roof (by means of the nuts applied to the top ends of the bolts) to form an anchor to the existing purlins. It will be noted that the bearer members 6 form additional purlins and have the effect of strengthening the roof structure. The fresh sheeting 4 is secured to the upper side of these additional purlins by conventional so-called Tek bolts.

If the existing purlin differs from the type shown, then hook bolts of appropriate form are selected to anchor onto them. Appropriate anchoring results for the entire overcladding roofing, and the lowermost and uppermost existing purlins will be sufficiently close to the eaves and the ridge of the roof. The overcladding roof then only requires finishing at the eaves and ridge and ends of the building with appropriate flashings.

I claim:

1. An overcladding structure for a building roof including an existing roof sheet (1) connected with a plurality of fixed parallel spaced purlins (3) by a plurality of existing fastening means (2), comprising (a) an outer roof sheet (4) arranged in spaced relation above the existing roof sheet;

(b) means connecting said outer roof sheet with the building roof, including a plurality of elongate bearer members (6) arranged between the outer and existing roof sheets opposite said purlins, respectively, and first connecting means additional to the existing fastening means, said first connecting means connecting said bearer members with said purlins, respectively; and (c) a mass of thermal insulation material (10) arranged in the space defined between said existing and outer roof sheets, whereby an insulated overcladding roof structure is provided for a building without removing the existing roof sheet.

2. Apparatus as defined in claim 1, wherein each of said elongate bearer members has a generally Z-shaped cross-sectional configuration defining a limb adjacent said inner roof sheet, said limb containing a plurality of spaced apertures (8); and further wherein said first connecting means comprise a plurality of hook bolts (9) extending through said apertures and through openings contained in the existing roof structure for hooked engagement with the purlins.

3. Apparatus as defined in claim 2, and further including a plurality of relatively short second bearer members (5) arranged in longitudinally spaced relation between each of said elongated bearer members and the existing roof sheet, respectively, said second bearer members containing a plurality of apertures (7) aligned with said elongate member apertures and adapted to receive said hook bolts.

4. Apparatus as defined in claim 3, wherein each of said second bearer members has a generally channel-shaped crosssectional configuration.

5. A method of providing an overcladding structure for a sloping building roof having an existing roof sheet connected with a plurality of fixed parallel spaced purlins by a plurality of existing fastening means, comprising the steps of (a) connecting a plurality of elongate bearer members with the purlins, respectively, by a plurality of first connecting means, said first connecting means being additional to the existing fastening means and said bearer numbers being arranged on the outer surface of the existing roof sheet opposite the purlins, respectively (b) connecting an outer roof sheet with said bearer members, said outer roof sheet being spaced above the existing roof sheet; and (c) inserting a mass of thermal insulation material into the space between said outer roof sheet and the existing roof sheet, whereby an insulated overcladding roof structure is provided for a building without removing the existing roof sheet.

* * * * *